US005123334A

United States Patent [19]

van Loo

[11] Patent Number: 5,123,334

[45] Date of Patent: Jun. 23, 1992

[54] PUMP OR MOTOR WITH SECONDARY PISTON CONNECTED TO GUIDE MEMBER OF A MAIN PISTON

[75] Inventor: Pieter J. van Loo, Heeswijk-Dinther, Netherlands

[73] Assignee: H.P. van der Waal B.V.I.O., Netherlands

[21] Appl. No.: 432,764

[22] PCT Filed: Jan. 6, 1989

[86] PCT No.: PCT/NL89/00001

§ 371 Date: Nov. 3, 1989

§ 102(e) Date: Nov. 3, 1989

[87] PCT Pub. No.: WO89/06303

PCT Pub. Date: Jul. 13, 1989

[30] Foreign Application Priority Data

Jan. 8, 1988 [NL] Netherlands ..... 8800036

[51] Int. Cl.[5] ..... F01B 9/00; F02B 25/12

[52] U.S. Cl. ..... 92/138; 92/150; 92/165 R; 123/53 A; 123/56 BC

[58] Field of Search ..... 92/147, 150, 152, 165 R, 92/138, 72, 73, 139; 417/462; 123/56 AC, 56 BC, 57 R, 57 A, 57 B, 74 AE, 61 R, 61 V, 62, 63, 53 A, 53 B, 70 R

[56] References Cited

U.S. PATENT DOCUMENTS

| | | | |
|---|---|---|---|
| 355,101 | 12/1886 | Randall | 123/61 V |
| 999,518 | 8/1911 | Peck | 123/56 AC |
| 1,086,180 | 2/1914 | Ibach | 123/56 AC |
| 1,365,666 | 1/1921 | Dinwiddie | 123/70 R |
| 2,938,506 | 5/1960 | Buchi | 123/74 AE |
| 3,200,797 | 8/1965 | Dillenberg | 92/138 X |
| 3,200,800 | 8/1965 | Du Bois | 92/147 X |
| 3,724,432 | 4/1973 | Tonnessen | 123/70 R X |
| 3,753,386 | 8/1973 | Scott, Jr. | 92/138 X |
| 4,030,458 | 6/1977 | Lamm | 417/462 X |
| 4,090,817 | 5/1978 | Erickson | 417/462 |
| 4,185,597 | 1/1980 | Cinquegrani | 123/57 B X |
| 4,407,240 | 10/1983 | Fromson | 123/61 R X |
| 4,723,895 | 2/1988 | Hayase | 417/462 X |
| 4,936,111 | 6/1990 | Wilkinson et al. | 417/462 X |

FOREIGN PATENT DOCUMENTS

| | | | |
|---|---|---|---|
| 0025071 | 3/1981 | European Pat. Off. | 92/138 |
| 2245738 | 3/1974 | Fed. Rep. of Germany | 92/138 |
| 2306796 | 8/1974 | Fed. Rep. of Germany | 92/138 |
| 2542172 | 3/1977 | Fed. Rep. of Germany | 92/138 |
| 2456842 | 1/1981 | France | 92/138 |
| 0133944 | 3/1920 | United Kingdom | 92/138 |
| 0280795 | 11/1927 | United Kingdom | 123/56 AC |

*Primary Examiner*—Edward K. Look
*Assistant Examiner*—John Ryznic
*Attorney, Agent, or Firm*—Foley & Lardner

[57] ABSTRACT

Pump or motor comprising at least one cylinder housing being closed at both ends and a piston body received in said housing so that at both ends of said housing a working compartment is formed, the piston body being provided with a cavity shaped such that in it one piston rod can be received, one end of which is connected to the piston body and the other end to a crankshaft which pass through the piston body.

5 Claims, 3 Drawing Sheets

FIG. 4
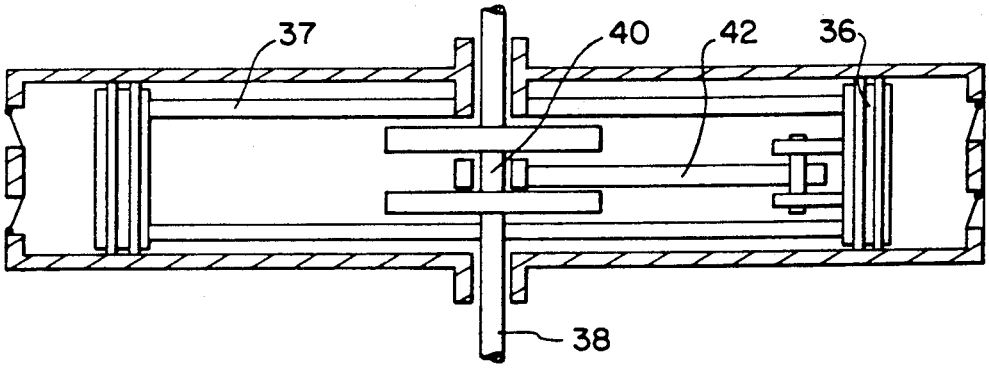
FIG. 3
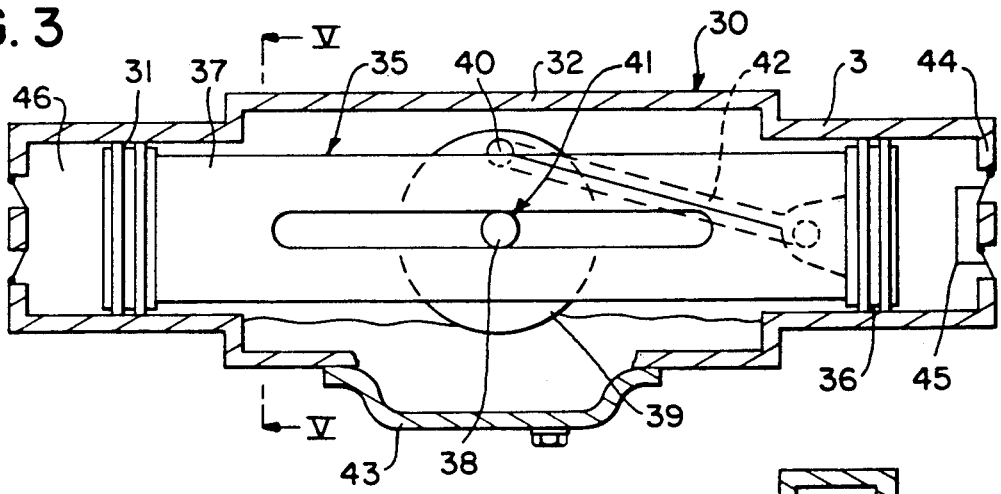
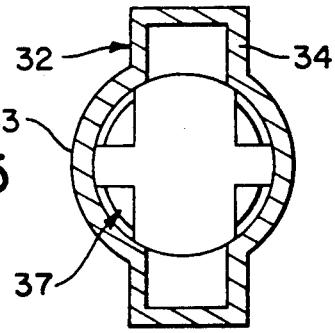
FIG. 5
FIG. 6
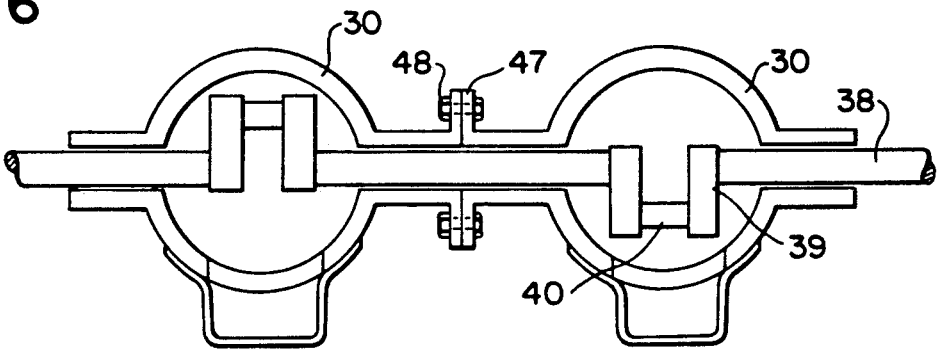

PUMP OR MOTOR WITH SECONDARY PISTON CONNECTED TO GUIDE MEMBER OF A MAIN PISTON

BACKGROUND OF THE INVENTION

The invention relates to a pump or motor comprising: at least one piston body; a cylindrical housing in which said piston body may reciprocate; a cover for closing of said housing for obtaining a closed compartment between said piston body and said housing; a piston rod connected to said piston body; a shaft rotatably supported by said housing and running in transverse direction in respect of the direction of movement of said piston body; and connecting means located between said shaft and said piston rod for converting either a rotational movement of said shaft into a rectilinear movement of said piston body or a rectilinear movement of said piston body into a rotational movement of said shaft or of a part cooperating with this.

A pump of the type described above can be used for compressing fluids, in particular for obtaining high pressures and when no large volumes have to be transported.

In case of a motor of the type described above a mixture of air and fuel is combusted in the closed compartment by means of a sparking plug, mounted in the cylinder cover. By this the piston body is brought into movement, said movement being converted into a rotational movement of the shaft.

In case of the known pumps and motors the cylindrical housing is usually connected to a crankcase supporting the shaft which is shaped as a crankshaft, and the piston rod is pivotally connected to said crankshaft and to said piston body.

Such a construction is relatively cumbersome because only one end surface of the piston is used and the length of the piston has to be such large that tilting of the piston is opposed as much as possible.

By U.S. Pat. No. 4,013,048 a motor is known comprising two piston bodies provided in two cylindrical housings being in coaxial alignment with each other. Both piston bodies are provided with a piston rod which is fixedly connected to the related piston. The free ends of the said rods are connected to a yoke housing provided with a central slot in transverse direction to the center line of the cylindrical housings, in which slot the crank of a crankshaft is moving. This also brings a cumbersome construction with it as well as an unfavourable loading of some parts of the motor.

OBJECTS AND SUMMARY OF THE INVENTION

Now the object of the invention is to remove these disadvantages and to this end a pump or motor according to the invention is characterized in that both ends of the substantially cylindrical housing are closed off for forming a working compartment at either side of the piston body. The piston body is provided with a cavity which is shaped such that in it one piston rod can be received and that the crankshaft can pass through the piston body.

According to one embodiment of the invention the cylindrical housing is provided in a cylindrical rotor, the axis of which is running transverse to the axis of the cylindrical housing, said rotor is rotatably supported by a casing in which the crankshaft is fixedly mounted such that a rotational movement of rotor is converted into a reciprocating movement of the piston body in said cylindrical housing or vice versa.

A very stable construction can be obtained when the crankshaft is provided with an eccentrically mounted circular disk and said piston rod is having an angular portion being supported by said disk.

In case of such an embodiment, the shaft can run through as one entire whole and can better transfer the loads exerted on it.

According to a further embodiment, the piston body is provided at least at one end with an additional piston rod in coaxial alignment with the cylindrical housing and fixedly connected to said piston body and sealingly extending through the related cylinder cover. The piston rod is connected to a secondary piston which may reciprocate in a secondary housing mounted to the cylindrical housing.

Obviously, the secondary piston will move together with the main piston body and can be used e.g. for compressing air for the combustion mixture or for pumping lubricant being used in the pump or motor itself.

According to an embodiment of the invention, the piston body is formed by two spaced-apart pistons which are connected by screwthreaded bolts provided with nuts and positioned outside of the center line of said piston body.

In this way the piston body can be assembled in a simple way by connecting two pistons by means of a number of bolts.

According to an other embodiment the piston body is formed by two spaced-apart pistons being connected by an intermediate piston with a larger diameter and being guided by a cooperating enlarged portion of the cylindrical housing.

In this way the dimensions of the crankshaft can be enlarged without enlarging the diameter of the two pistons forming part of the piston body.

In this case also an auxiliary piston rod can be provided running parallel to the center line of the intermediate piston and being connected near the circumference of the intermediate piston. The auxiliary piston rod extends in a secondary cylindrical housing provided distinct from the housing of the main piston body and is connected to a secondary piston reciprocating in the secondary cylindrical housing.

The secondary piston and the housing for it thus can be positioned besides the main cylindrical housing so that the length of the pump or motor will not be increased.

Two or more pumps or motors according to the invention can easily be coupled to each other by placing the cylindrical housings of it the pumps or motors each other so that the crankshafts of these are in line with each other and can be connected to each other, the axes of the housings being positioned in parallel planes and being parallel to or are making an angle with each other, and means being present to connect the housings to each other.

Obviously in this way the capacity of a device can be increased in a very simple way.

BRIEF DESCRIPTION OF THE DRAWING

Now the invention is described on hand of embodiments shown in the drawing, in which:

FIG. 3 schematically shows partially in section and partially in side view of a motor according to the invention;

FIG. 4 schematically shows a partial side view and a partial section of the motor of FIG. 3 in a direction transverse to FIG. 3;

FIG. 5 schematically shows a section according to the line V—V of FIG. 3;

FIG. 6 schematically shows a combination of two pumps or motors according to the invention;

DETAILED DESCRIPTION OF THE PREFERRED EMBODIMENTS

Figure 2:
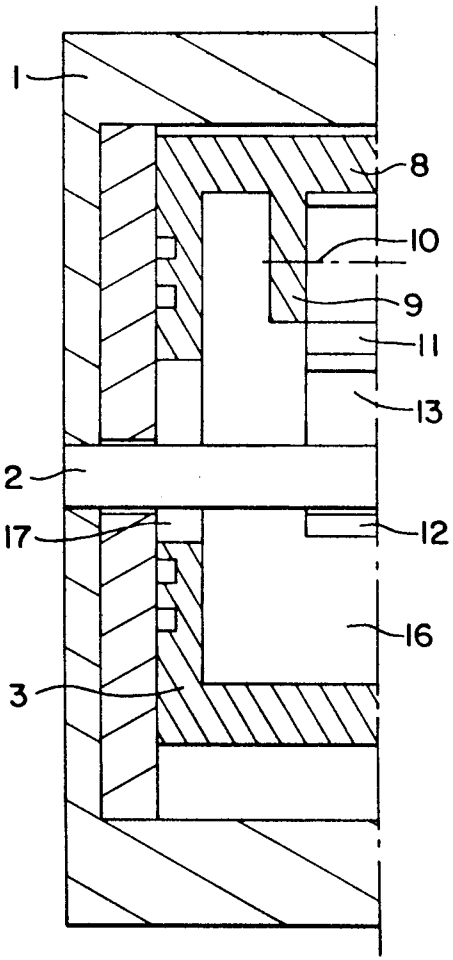
FIG. 2 schematically shows a part of a section according to the line II—II of FIG. 1.
Figure 1:
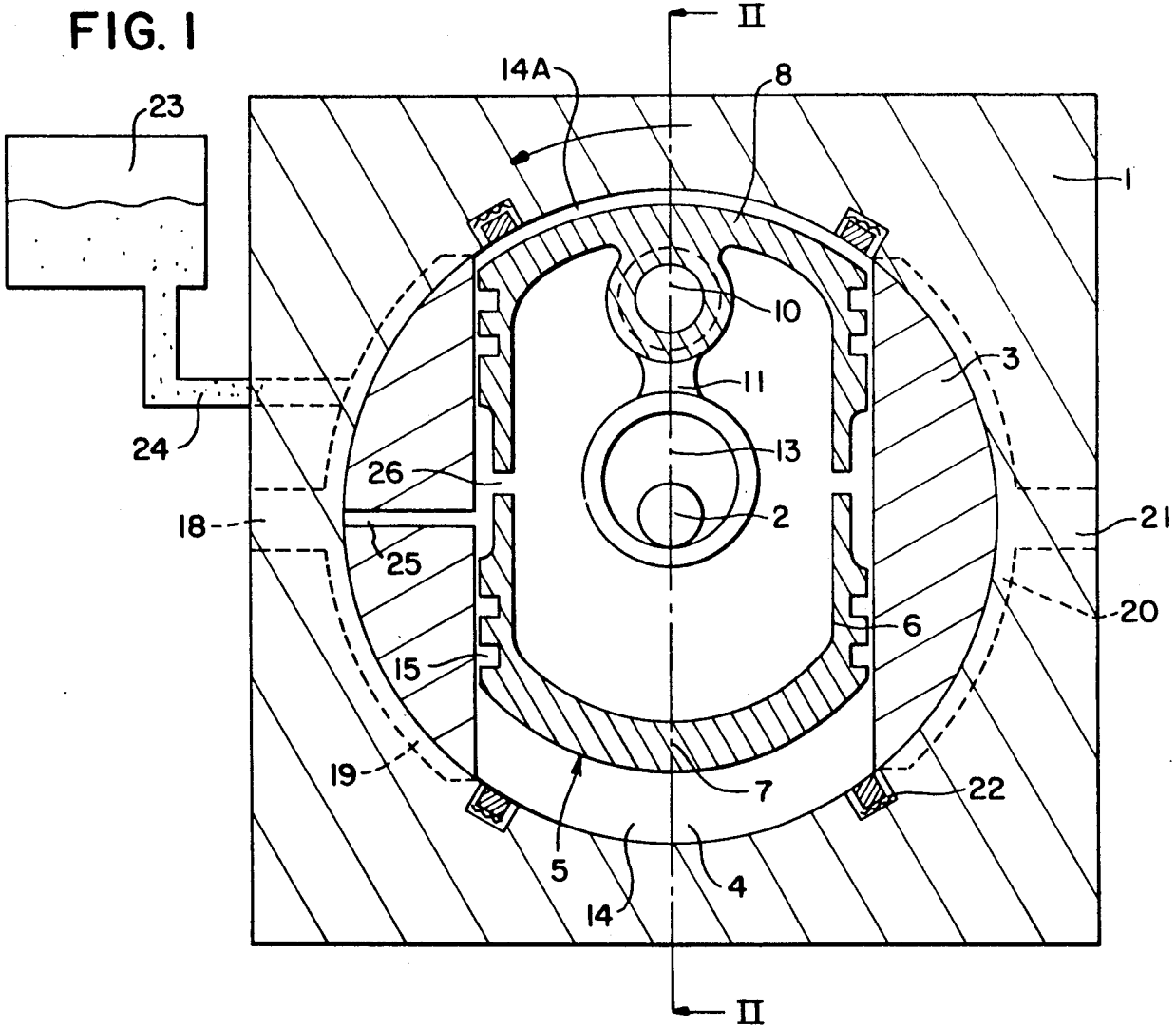
FIG. 1 schematically shows a section of an embodiment of a pump according to the invention in which the piston body is received in a rotor which is rotatably mounted in a housing.

The pump shown in the FIGS. 1 and 2 comprises a housing 1 in which one end of a shaft 2 is fastened. In the housing 1 the rotor 3 is rotatably supported and can be driven from the outside of the housing in a conventional wax which is not further indicated. The rotor 3, e.g., can be provided with a hollow shaft surrounding the shaft 2.

In the rotor 3 a cylindrical housing 4 is provided in which a piston body 5 can reciprocate. The piston body 5 comprises a cylindrical portion 6 and the bottoms 7 and 8. The bottom 8 is provided with lugs 9 for taking up a piston pin 10 to which one end of a piston rod 11 is connected, the other end of this rod being provided with an angular portion 12 rotatable mounted on a circular disk 13 which is fixedly connected to the shaft 2.

Obviously, when the rotor 3 is rotated, the piston body 5 will reciprocate in the housing 4 so that the volume of the compartment 14, present between the piston bottom 7 and the housing 1 will decrease and ultimately will have the volume of the compartment 14A between the piston bottom 8 and the housing 1. So the pump according to the FIGS. 1 and 2 will work as compressor.

In the known way the piston body 5 will be provided with piston rings 15 for sealing the compartments 14 and 14A and with a cavity 16 for receiving the piston rod and other parts. The cavity 16 comprises two slots 17 in the cylindrical portion 6 through which slots the shaft 2 can pass.

Supplying fluid to a compartment takes place by means of the supply opening 18 in the housing 1. The opening 18 empties into the groove 19. The compressed fluid leaves the compartment via a groove 20 and an outlet opening 21.

The sealing between the cylindrical surfaces of the housing 1 and the rotor 3 can take place by means of sealing strips 22 and by further circumferential strips between the radial faces of the housing 1 and the rotor 3.

A lubricant container 23 can be present provided with an outlet 24 for supplying lubricant to the engaging surfaces of housing 1 and rotor 3, the cylindrical housing 4 and the piston body 5 and the engaging portions of piston pin 10, piston rod 11, circular disk 13 etc. To this end, a bore 25, an opening 26 and further means can be used to provide the required flow paths for the lubricants.

Obviously, the supply opening 18 and the outlet opening 21 can be provided with check valves, while between other parts, roller or needle bearings can be provided, this all in the known way.

FIGS. 3-5 show an embodiment of a motor according to the invention comprising a housing 30 having two cylindrical portions 31 and a connecting portion 32. The connecting portion 32 consists of the cylindrical portions 33 and extended portions 34.(FIG. 5.)

In the housing 30 a piston body 35 is received comprising two cylindrical end portions 36 which are connected to each other by four elongated portions 37, as appears in particular from FIG. 5.

Through the opening between the elongated portions 37 a pin 38 may pass, being provided with two disks 39 between which a pin 40 is mounted for obtaining a crankshaft 41. One end of the piston rod 42 is connected, connected to the 40. The other end of the piston is connected with the cylindrical end portion 36.

The connecting portion 32 can be provided with an oil sump 43 and the disks 39 can take cars for bringing oil to the moving parts.

In the covers 44 valves 45 are mounted for either supplying a mixture of gas and fuel to the compartment 46 or for removal of the combustion gases. The valves 45 can be controlled in a known way, e.g. by means of a cam mounted on the shaft 38, rocker arms and valve lifters. The parts not being indicated in the drawing for the sake of convenience.

When the device according to the FIGS. 3-5 is used as a motor, each cover 44 will be provided with a sparking plug in the known way. When the device is used as a pump, no sparking plug is needed, and the valves 45 possibly may be in the shape of simple check valves.

FIG. 6 shows the possibility for assembling two devices according to the present invention having about the shape of the device shown in the FIGS. 3-5, so that the same reference numbers are used for corresponding parts. In this case the houses 30 each are provided with a flange 47, the flanges being connected to each other by means of bolts 48. The shafts 38 of the two devices are connected to each other or are forming one part between the crank portions 39, 40.

Figure 7:
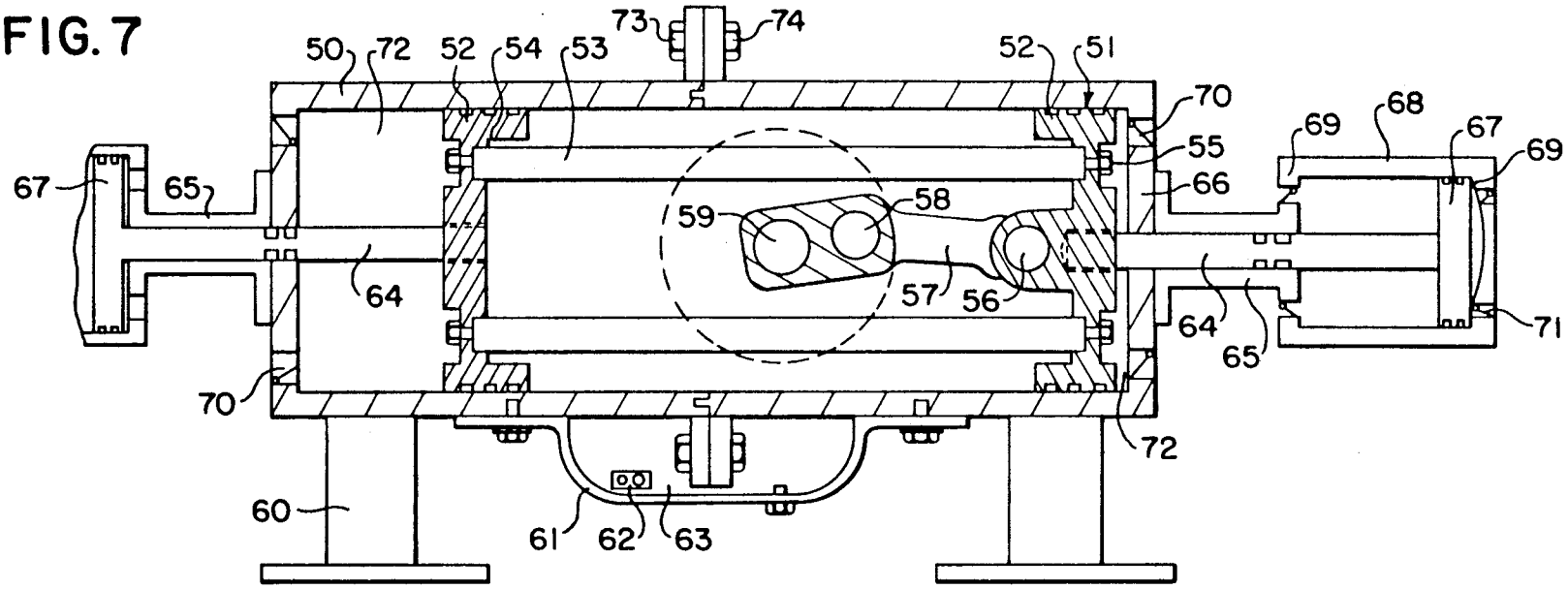
FIG. 7 schematically shows partially in section and partially in side view a pump according to the invention provided with secondary pistons movable in secondary housings.

The device according to FIG. 7 comprises a cylindrical housing 50 having a piston body 51 which is consists of two mainly cylindrical portions 52 connected by means of four bolts 53 having a collar 54 against which the portion 52 come to rest. Nuts 55 connect the portions 52 fixedly to the bolts 53.

One of the portions 52 is provided with a piston pin 56 for connecting the piston rod 57 to the piston body 51. The other end of the piston rod 57 is connected to the shaft 58 of the crank shaft 59. The housing 50 is supported by two supports 60 and further comprises an oil sump 61 in which a gear wheel pump 62 is mounted for supplying oil 63, present in the oil sump 61, to the places where this is needed.

Both ends of the piston body 51 are connected to a secondary shaft 64 running through a sleeve 65 connected to the cover 66 of the housing 50. The other end of the shaft 64 is connected to a secondary piston 67 movable in a secondary housing 68 closed by covers 69.

In the covers 66 valves 70 can be mounted and in the covers 69 valves 71.

It is possible to connect outlet valves 71 with inlet valves 70 so that air being sucked into a compartment 72 can have a somewhat higher pressure than when it is directly sucked in from the surrounding atmosphere. To this end, it is possible to connect the two outlet valves 71 of the secondary housing 68 with an intermediate reservoir before the air from this is supplied to a compartment 72.

As shown in FIG. 7 the housing 50 is divided into two sections being connected to each other by means of flanges 73 and bolts 74.

Figure 8:
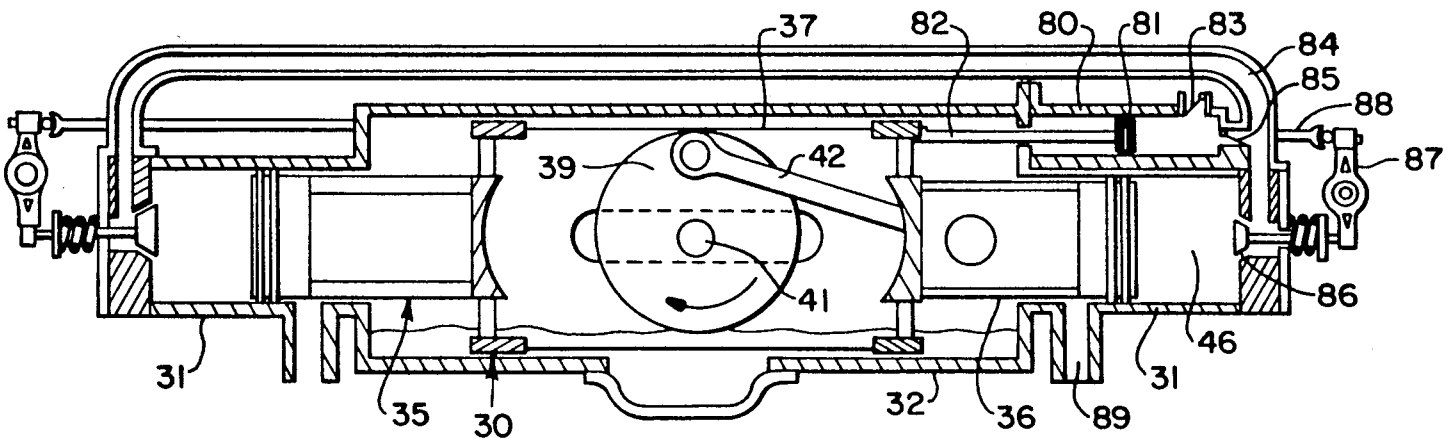
FIG. 8 schematically shows partially in side view and partially in section a two-stroke diesel engine.

FIG. 8 shows a device the main portion of which is identical to that of the device of FIGS. 3-5 so that corresponding parts are indicated with the same reference numbers.

The device according to FIG. 8 comprises the cylindrical housing 30 consisting of a first connecting portion 32 which slideably received main portion 37 of piston body 35, and second and third cylindrical end portions 31 which are connected to opposed ends of the first connecting portion 32. In the housing 30 the piston body 35 is received comprising two end portions 36 and the an elongated main portion 37 connecting the end portions 36 to one another. The crankshaft 41 is connected to the piston body 35 by means of the piston rod 42. The shape of the piston body 35 can be somewhat different from the piston body shown in FIGS. 3-5 but this is not important.

FIG. 8 shows that besides the housing portion 31 a secondary housing 80 is mounted in which the secondary piston 81 is moving which is connected to the main piston body 35 via an auxiliary piston rod 82.

By means of the secondary piston 81, air is sucked into the housing 80 by means of a valve 83. This air is compressed and is supplied to an inlet line 84 via a valve 85. From the inlet line 84, the compressed air is brought into the compartment 46 by means of the valve 86, which is in turn controlled by a rocket arm 87 and a valve lifter 88.

In the compartment 46, fuel will be injected and a mixture of air and fuel will be combusted by means of a glow plug, not shown.

After the combustion of the fuel, the combustion gases can leave the compartment 46 by means of the opening 89, and a good removal of the combustion gases can be obtained by opening the valve 86 so that an optimum filling of the compartment 46 can be reached.

Obviously, the left side of the housing 30, shown in FIG. 8, also can be provided with a secondary housing 80 as shown in the right side of this Figure.

It will be obvious that only some possible embodiments of a pump or a motor according to the invention are shown in the drawing and are described above and that many modifications can be applied without leaving the inventive concept.

I claim:

1. An apparatus comprising:

(A) a piston body which has opposed end portions and a main portion which is located between said end portions in axial alignment with said end portions, which has a cavity formed therein, and which has a larger diameter than said end portions;

(B) a cylindrical housing in which said piston body reciprocates, and which has opposed ends which are closed off by cylinder covers to form a working compartment at each end portion of said piston body, said main portion of said piston body being slideably disposed in a first connecting portion of said cylindrical housing which has a substantially constant width throughout and which has a greater diameter than the remainder of said cylindrical housing, said cylindrical housing having a second portion which forms one of said opposed ends of said cylindrical housing and in which is disposed one of said end portions of said piston body;

(C) a piston rod connected to said piston body;

(D) a shaft rotatably supported by said first portion of said cylindrical housing extending through said cavity of said piston body transversely to the direction of movement of said piston body;

(E) connecting means, located between said shaft and said piston rod, for converting one of rotational movement of said shaft into a rectilinear movement of said piston body and rectilinear movement of said piston body into rotational movement of said shaft;

(F) a secondary cylindrical housing which is provided beside said second portion;

(G) an auxiliary piston rod which is fixedly connected to said main portion of said piston body near an outer end thereof and which extends in parallel to a longitudinal centerline of said main portion of said piston body in said secondary cylindrical housing; and (H) a secondary piston which is fixedly connected to said auxiliary piston rod and which reciprocates in said secondary cylindrical housing.

2. An assembly according to claim 1, further comprising a fluid inlet line connecting said secondary cylindrical housing to said second portion of said cylindrical housing.

3. An assembly according to claim 2, wherein said cylindrical housing further comprises an a third portion receiving the other of said end portions of said piston body and wherein said fluid inlet line connects said main piston body housing to said additional main piston body housing.

4. An assembly according to claim 1, further comprising a source of lubricant located in said first portion of said cylindrical housing.

5. An assembly according to claim 4, wherein said source of lubricant comprises an oil sump and an oil pump.

* * * * *